US005263672A

United States Patent [19]

He

[11] Patent Number: 5,263,672

[45] Date of Patent: Nov. 23, 1993

[54] ECONOMICAL AND COLLAPSIBLE WASTE BASKET

[76] Inventor: Te-Liang He, Suite 1, 11F, 95-8 Chang Ping Road, Sec. 1, Tiachung, Taiwan

[21] Appl. No.: 786,738

[22] Filed: Nov. 1, 1991

[51] Int. Cl.[5] ..... A63B 55/04

[52] U.S. Cl. ..... 248/97; 248/99

[58] Field of Search ..... 248/95, 97, 99, 100, 248/101, 164, 432; 220/401, 404

[56] References Cited

U.S. PATENT DOCUMENTS

| | | | |
|---|---|---|---|
| 2,957,736 | 10/1960 | Olander et al. | 248/164 |
| 3,186,667 | 6/1965 | Meuer | 220/404 X |
| 3,633,859 | 1/1972 | Vosbikian | 248/97 |
| 4,031,689 | 6/1977 | Sullivan | 248/97 X |
| 4,061,305 | 12/1977 | Beekencamp | 248/432 |
| 4,332,361 | 6/1982 | McClellan | 248/95 |
| 4,366,916 | 1/1983 | Guido et al. | 248/97 X |
| 4,638,968 | 1/1987 | Auten | 248/97 |
| 4,840,336 | 6/1989 | Stroh et al. | 248/97 |
| 4,921,193 | 5/1990 | Benesch | 248/97 |
| 4,921,196 | 5/1990 | Rudko | 248/97 |

*Primary Examiner*—David A. Scherbel
*Assistant Examiner*—Derek J. Berger

[57] ABSTRACT

A waste basket comprises a pair of elongate lateral members having loop type handles formed on respective upper edges thereof, a pair of flaps with snap fitting projections formed on respective lateral edges thereof, and a pair of roughly U-shaped wire supports. The snap fitting projections on the flaps engage pivot holes on corresponding ends of respective lateral members to interconnect the two, with the terminal ends of the wire supports being frictionally inserted into corresponding receiving holes on the respective lateral members to complete the assembly of the waste basket. A waste bag which can be an ordinary shopping bag is then disposed within the waste basket with the handling loops of the shopping bag wrapped over the handles and the flaps, which are swivelably secured, can be swiveled around to rest within the bag.

1 Claim, 3 Drawing Sheets

ECONOMICAL AND COLLAPSIBLE WASTE BASKET

BACKGROUND OF THE PRESENT INVENTION

The present invention relates to waste baskets and more particularly to a waste basket that is economical to manufacture and use and that is collapsible for storage.

Waste baskets for paper and other household or office refuse are available in a broad range of sizes and shapes with the conventional waste basket shown in FIG. 1 being exemplary.

As depicted, the conventional waste basket comprises a waste container 1 usually formed from a molded plastic to which a lid 2 is attached over the opening thereof. An externally supplied plastic waste bag 3 is shown disposed within the waste container 1 for facilitating the removal of refuse therefrom. A foot pedal 4 disposed on the base of container 1 enables operation of lid 2 without requiring a user to physically touch the waste basket.

While the conventional waste basket is relatively convenient and expedient, it does have its shortcomings.

In particular, conventional waste baskets have an unnecessated bulk when not in use hampering its portability and ease of storage, a factor which is considerable for a user who travels frequently and hence desires compactness and portability in his or her appliances or where space is an expensive commodity.

Further, any reduction of material usage in a waste basket that can be made without reducing its waste storage capacity would obviously be desirable as a cost savings measure.

In light of these needs the waste basket of the present invention was designed so as to provide a collapsible structure utilizing a minimal amount of inexpensive material.

SUMMARY OF THE PRESENT INVENTION

The present invention has as a main object to provide a waste basket with a collapsible structure and that utilizes a minimal amount of material therein,so as to be easily stored or transported and inexpensive to manufacture.

In accordance therewith, a waste basket comprises a pair of elongate lateral members interconnected by a pair of plate like flaps whose upper corners are releasably and swivelably secured to corresponding ends of the respective lateral members to define a generally rectangular opening, and a pair of roughly U-shaped wire support members whose terminal ends are inserted into corresponding receiving holes in the respective lateral members.

After assembly of the waste basket, which is accomplished entirely without the need of any hand tools, a waste bag, and more expediently a shopping bag which is readily available free of charge to a user while shopping, is disposed within the waste basket with the open end thereof attached to the lateral members. The swivelable flaps are then pivoted upwards and released so as to come to rest within the opening of the waste bag, preventing the collapse of the opening and acting as a guide for any refuse dispensed therein.

The waste basket can just as quickly be disassembled after which all components thereof can be laid flat for efficient storage or transport.

A detailed description of a preferred embodiment of the present invention along with accompanying drawings is provided below.

A BRIEF DESCRIPTION OF THE DRAWINGS

DETAILED DESCRIPTION OF THE PREFERRED EMBODIMENT

Figure 2:
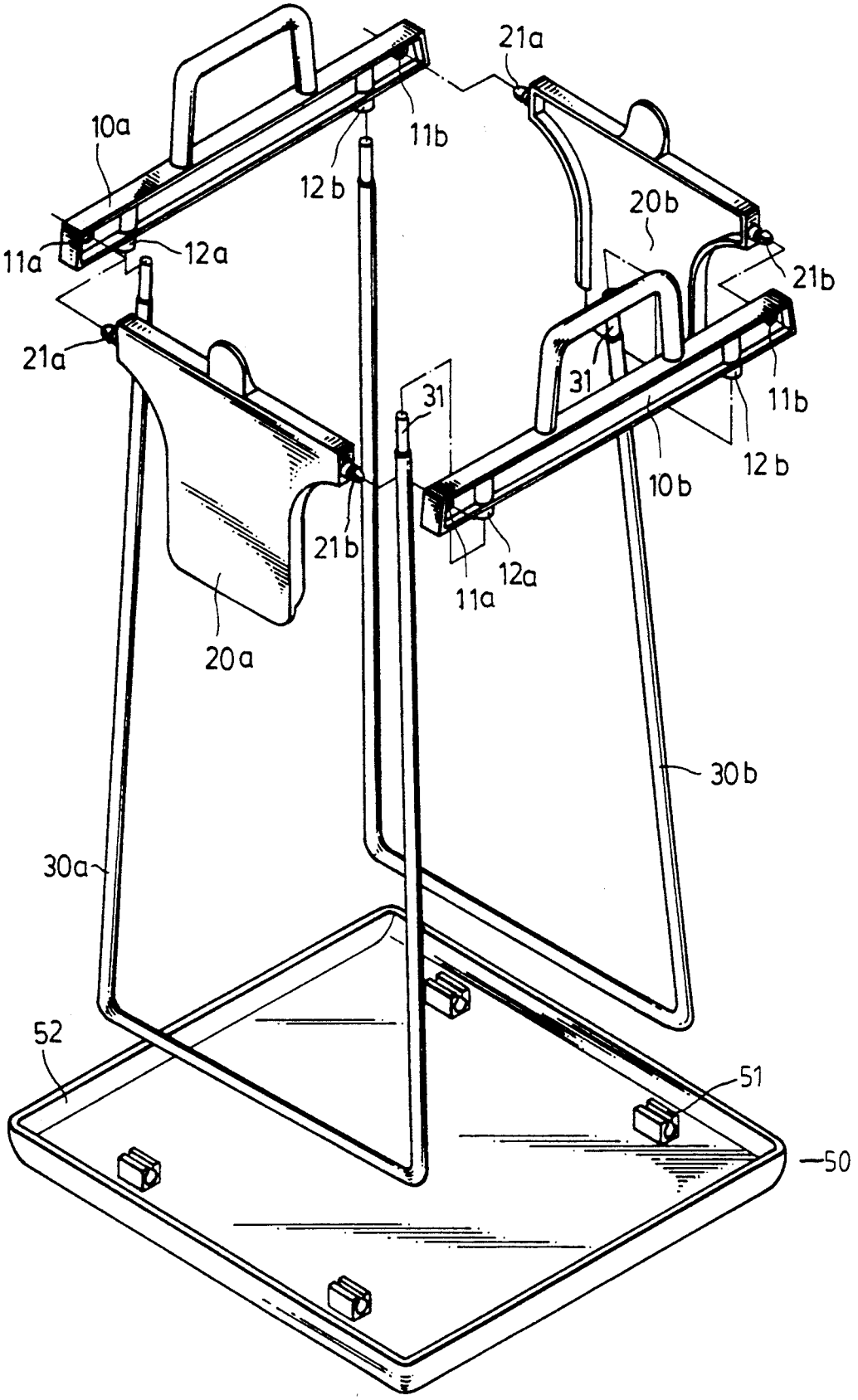
FIG. 2 is an exploded perspective view of an embodiment of the waste basket of the present invention.

Referring to FIG. 2, a preferred embodiment of the waste basket of the present invention comprises a pair of elongate, bar like lateral members, 10*a* and 10*b*, formed from injection molded plastic, an interconnecting pair of roughly tongue shaped flaps, 20*a* and 20*b*, also made from injection molded plastic, and a pair of roughly U-shaped wire supports, 30*a* and 30*b*, made from coated steel wire similar to that used in coat hangers and similar articles.

Lateral members, 10*a* and 10*b*, are also each provided with a pair of pivot holes, 11*a* and 11*b*, formed on respective end portions thereof and a pair of blind receiving holes, 12*a* and 12*b*, formed on the lower edge thereof and aligned in a nearly vertical orientation, each being disposed inwardly from respective pivot holes, 11*a* and 11*b*, thereon.

Each flap, 20*a* and 20*b*, has a pair of protrusions, 21*a* and 21*b*, formed on respective lateral sides of the upper edges thereof, each having an elastic head with a reduced diameter neck. Protrusions, 21*a* and 21*b*, of a first flap 20*a* are snap fitted into respective pivot holes 11*a* on corresponding end portions of lateral members, 10*a* and 10*b*, and protrusions, 21*a* and 21*b*, of a second flap 20*b* are snap fitted into respective pivot holes 11*b* on the opposite end portions thereof to interconnect lateral members, 10*a* and 10*b*, and define a rectangular opening.

As the diameter of the neck portion of each snap fitting protrusion, 21*a* and 21*b*, is slightly less than that of pivot holes, 11*a* and 11*b*, flaps 20*a* and 20*b* are free to swivel about the lateral members.

The bare terminal ends 31 of respective vertical arms of each wire support, 30*a* and 30*b*, are frictionally inserted into corresponding pairs of receiving holes, 12*a* or 12*b*, on respective lateral members, 10*a* and 10*b*, to complete the assembly of the waste basket.

An optional rectangular base pan 50 is further provided, having a raised peripheral rim 52 and four C-section elastic securing appendages 51 formed thereon for attachment to wire supports 30*a* and 30*b*.

Figure 3:
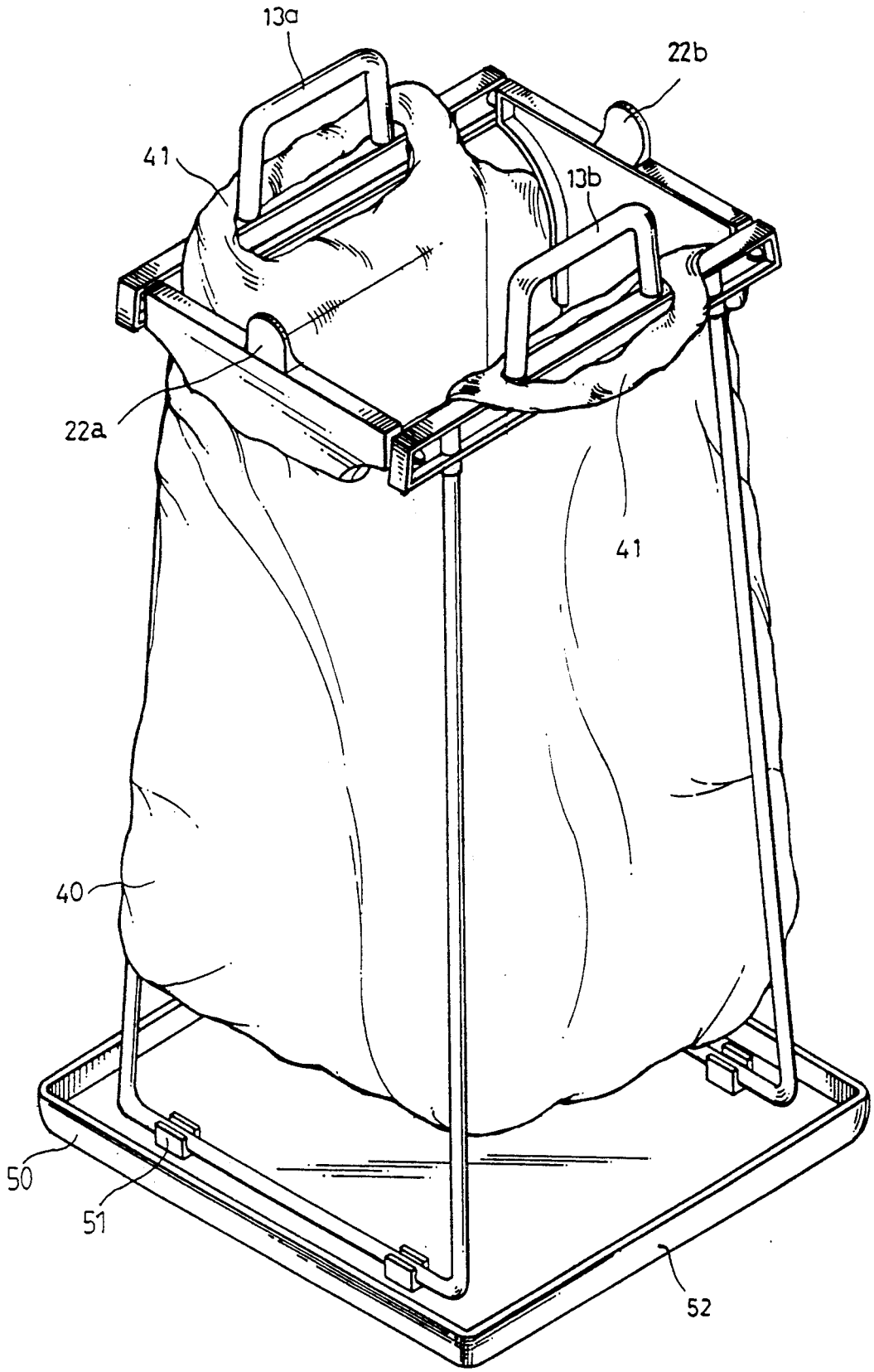
FIG. 3 is an assembled perspective view of the waste basket of the present invention with a shopping bag disposed therein.

Referring to FIG. 3, the waste basket can then be stood up in a vertical position and a plastic shopping bag 40, acting as a refuse container, disposed therein through the rectangular opening. The loop portions 41 formed on respective sides of bag 40 are wrapped over respective looped shaped handles, 13*a* and 13*b*, of respective lateral members, 10*a* and 10*b*.

Handles, 13*a* and 13*b*, formed on the upper edges of lateral members, 10*a* and 10*b*, also serve to facilitate sanitary transport of the waste basket when in use.

Flaps, 20*a* and 20*b*, are then flipped over so as to rest against the interior of bag 40, preventing the collapse of the opening thereof and also serving to guide any refuse discarded therein towards the lower portions thereof. A pair of tabs, 22*a* and 22*b*, on the upper portions of respective flaps, 20*a* and 20*b*, facilitates this action or the reverse operation in which the flaps are swiveled out from the waste bag.

The commonly available paper grocery bags can also be adapted for use with the waste basket by cutting suitably positioned slits thereon to form attachment loops.

If desired, base pan 50 can attached below the waste basket by snap engaging the base portions of wire supports, 30*a* and 30*b*, with respective pairs of elastic securing appendages 51 on opposing edges thereof, wherein base pan 50 would serve to collect any liquid detritus that perchance may drip or seep downward from the waste bag and increase the stability of the waste basket so as to decrease the likelihood of its being turned over.

When required, the waste basket can be rapidly disassembled afterwhich all members thereof could be laid flat for convenient storage or transport.

Figure 1:
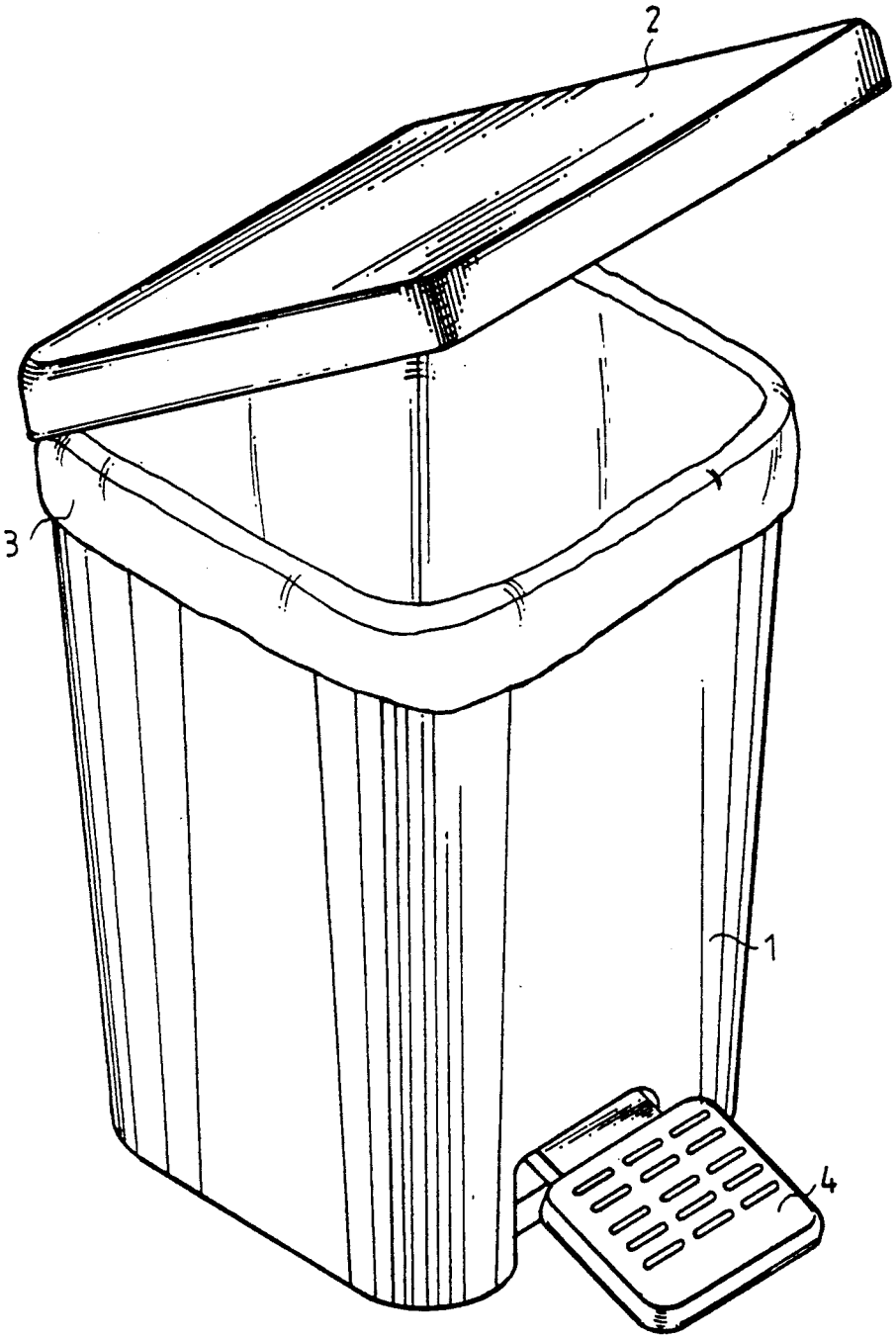
FIG. 1 is a perspective view of a conventional waste basket with a waste bag disposed therein.

In comparison with conventional waste baskets, the waste basket of the present invention uses far less material with a commensurate reduction in cost. Furthermore, unlike the waste basket of the present invention conventional waste baskets similar to that depicted in FIG. 1 usually require a user to roll the entire edge of a conventional waste bag around the rim thereof to maintain the opening.

Note that as the waste basket of the present invention can utilize the common shopping bags dispensed free of charge at most shopping areas, the need for separately purchased waste bags is obviated, further increasing its economy. Moreover, the usage of shopping bags is essentially a recycling of what commonly is a major source of refuse in many households, further aiding the cause of a cleaner domestic environment.

Obviously, many variations or modifications to the present invention could occur to a person of average skill in the art and as such the scope and spirit of the present invention should not be limited by the description provided above but by the appended claims and their legal equivalents.

I claim:

1. A structure of a waste basket comprising:

a pair of elongate lateral members defining an upper and lower edge, each said lateral member having a pair of pivot holes formed on respective end portions thereof, a pair of receiving holes formed on the lower edge thereof at predetermined positions thereon, and a handle portion projecting from the upper edge thereof;

a pair of plate-like roughly tongue shaped flaps, each said flap having a projecting tab on an upper edge thereof and a snap fitting projection formed on respective lateral edges thereof, said projections of each said flap engaging said pivot holes on corresponding end portions of respective said lateral members to releasably interconnect said lateral members and define a generally rectangular opening, said flaps being swivelably secured to said lateral members;

a pair of roughly U shaped wire like support members, each said support member having a pair of vertically oriented arms with the terminal ends thereof frictionally inserted into corresponding said receiving holes in respective said lateral members to releasably secure said support member therewith;

a generally rectangular base pan having a raised peripheral rim and at least one pair of elastic snap engaging securements provided on respective opposing edges of said base pan, with a base portion of each said support member engageable with a said snap engaging securement so as to releasably attach said waste basket over said base pan;

wherein, a waste bag with a pair of loops formed on opposite sides of the opening thereof can be disposed in said waste basket through the rectangular opening defined by said lateral members and said flaps, said loops can be wrapped over said handle portions, and said flaps can be swiveled around to rest within said waste bag.

* * * * *